US005465590A

United States Patent [19]

Van Steenburgh, Jr. et al.

[11] Patent Number: 5,465,590

[45] Date of Patent: * Nov. 14, 1995

[54] REFRIGERANT RECLAIM WITH AIR PURGE

[75] Inventors: Leon R. Van Steenburgh, Jr., 850 E. Lane Devils Gulch Rte., Estes Park, Colo. 80517; David S. Brainard, Aurora, Colo.

[73] Assignee: Leon R. Van Steenburgh, Jr., Estes Park, Colo.

[ * ] Notice: The portion of the term of this patent subsequent to Mar. 8, 2011, has been disclaimed.

[21] Appl. No.: 207,787

[22] Filed: Mar. 7, 1994

Related U.S. Application Data

[63] Continuation-in-part of Ser. No. 7,500, Jan. 22, 1993, Pat. No. 5,291,743, which is a continuation of Ser. No. 332,235, Mar. 31, 1989, Pat. No. 5,195,333, which is a continuation of Ser. No. 109,958, Oct. 19, 1987, abandoned.

[51] Int. Cl.[6] ..... F25B 43/04

[52] U.S. Cl. ..... 62/195; 62/475; 62/292

[58] Field of Search ..... 62/195, 475, 292, 62/85, 77

[56] References Cited

U.S. PATENT DOCUMENTS

| | | | |
|---|---|---|---|
| 2,321,964 | 6/1943 | Zeiber | 62/195 |
| 2,327,081 | 8/1943 | Walters | 62/475 |
| 2,920,458 | 1/1960 | Watkins | 62/195 |
| 5,291,743 | 3/1994 | Van Steenburgh, Jr. et al. | 62/195 |

*Primary Examiner*—John M. Sollecito
*Attorney, Agent, or Firm*—Beaton & Folsom

[57] ABSTRACT

A refrigerant reclaim system including an automatic air purge system. The refrigerant reclaim system has an evaporator, oil separator, compressor, condenser, storage tank, and a filter-drier. An improvement relates to an automatic air purge system having an evaporator to concentrate noncondensable gases in an isolated area of the refrigerant reclaim system so as to minimize the loss of refrigerant vapor during purge operations; a differential thermostat and an insulated enclosure are used within the system. The air purge system is not limited to use with a refrigerant reclaim, and is suitable for use with any refrigeration system from which noncondensable gases are to be purged with minimal loss of refrigerant vapor.

6 Claims, 8 Drawing Sheets

REFRIGERANT RECLAIM WITH AIR PURGE

RELATED U.S. APPLICATION DATA

This is a continuation-in-part of application Ser. No. 08/007,500 filed Jan. 22, 1993 now U.S. Pat. No. 5,291,743, which is in turn a continuation of application Ser. No. 07/332,235 filed Mar. 31, 1989 now U.S. Pat. No. 5,195,333, which is in turn a continuation of application Ser. No. 07/109,958 filed Oct. 19, 1987 now abandoned.

FIELD OF THE INVENTION

This invention relates most generally to refrigerant handling systems having an automatic air purge. The specific kind of refrigerant handling system discussed herein is a refrigerant reclaim system. The refrigerant reclaim system is a method and apparatus for removing refrigerant from a refrigeration system, confining it so as to avoid its escape to the atmosphere, separating contaminants from the refrigerant and returning the refrigerant to the refrigeration system or discharging it to a storage container. A basic reclaim apparatus is described in co-pending application Ser. No. 07/332,235 now U.S. Pat. No. 5,195,333 of Van Steenburgh, Jr., and the reclaim method is described in U.S. Pat. No. 5,072,593 of Van Steenburgh, Jr.

An improvement to the reclaim apparatus and method relates to the incorporation therein of an automatic air purge system having an evaporator to concentrate noncondensable gases in an isolated area of the refrigerant reclaim system so as to minimize the loss of refrigerant vapor during purge operations. The air purge system is not limited to use with a refrigerant reclaim, and is suitable for use with any refrigeration handling system from which noncondensable gases are to be purged with minimal loss of refrigerant vapor. Optionally, the air purge of this invention can be set to indicate that purging is necessary, and an operator may undertake a manual purge.

BACKGROUND OF THE INVENTION

In the past, little attention was paid to the storage or recycling of refrigerant. When refrigeration systems were being repaired or when the refrigerant, such as those sold under the brand name FREON, was contaminated sufficiently to affect the effectiveness of refrigeration, the refrigerant was vented into the atmosphere.

Recent developments have, however, created a demand for systems capable of storing refrigerant while at the same time purifying the contaminated refrigerant. The United States, as have several other countries, has become a signatory of the "Montreal Protocol on Substances that Deplete the Ozone Layer," which restricts future production of fully halogenated chlorofluorocarbons. Pursuant to this international mandate, future production of all currently used refrigerants are to be drastically cut by the end of the century. In addition to this development, the United States Environmental Protection Agency has classified several widely used refrigerants as hazardous substances under the Resource Conservation and Recovery Act ("RCRA").

The combination of these two regulatory developments accentuates the necessity for a device which will store and purify refrigerant, eliminating the possibility of unlawful emissions and the necessity for purchasing refrigerants in an artificially constrained market. The present invention relates to improvements on the refrigerant reclaim apparatus as described in U.S. Pat. No. 5,195,333 of Van Steenburgh, Jr.

The co-pending application discloses an apparatus for drawing refrigerant from a container, or a refrigeration system to be repaired, heating the refrigerant sufficiently to maintain it in a gaseous state while it passes through an oil separator into the intake of a compressor. Compressed gaseous refrigerant is discharged from the compressor and passed through a heat exchanger to heat the incoming liquid refrigerant and then passes through to a condenser where it is liquefied. The liquefied refrigerant is passed from the condenser into a storage tank from the bottom of which liquid refrigerant flows through a filter-drier and an expansion device for reconverting the liquid refrigerant to a gaseous form. From the expansion device the gaseous refrigerant passes through a coil submerged in the liquid in the storage tank and then is passed back to the intake of the compressor.

The temperature of the liquid in the storage tank is lowered by the chilling effect of the expanding gaseous refrigerant passing through the coil submerged in the liquid. The refrigerant can be repeatedly passed from the chill tank through the filter-drier, expansion device, cooling coil, compressor, heat exchanger, condenser and back to the storage tank. This repeated process will progressively lower the temperature of refrigerant in the storage tank.

The apparatus described in the co-pending application provides several advantages over the prior art. There are, however, several additional attributes that are desirable in refrigerant reclaim systems. In particular, when purging air from the system, it has become increasingly desirable to reduce the amount of vaporized refrigerant that is entrained with the air that is being purged.

When air is present in a refrigeration reclaim system, it becomes trapped on the high pressure side of the system in the space above the liquid refrigerant in the storage tank. Here it becomes an homogeneous mixture with the refrigerant vapor and adds its partial pressure to the refrigerant saturation pressure. This increased pressure causes the system to function less efficiently because the compressor must pump against this additional high side pressure. It is, therefore, desirable to eliminate air (or, more generally, all noncondensable gases) from refrigerants in a refrigerant handling system such as a refrigerant reclaim.

While an air vent such as that shown in co-pending application Ser. No. 07/332,235 now U.S. Pat. No. 5,195,333 of Van Steenburgh, Jr. will remove air from the storage tank, it also releases a quantity of vaporized refrigerant into the atmosphere. This is costly both from an economic and from an environmental perspective. What is desired is an automatic air purge apparatus that will remove air and other noncondensable gases from the refrigerant being handled.

Air purge systems for removing air from a refrigerant reclaim or other refrigerant handling system are described in U.S. Pat. Nos. 5,005,369 of Manz and 5,063,749 of Manz. The air purge system of this invention takes the different approach to the problem which is exemplified in U.S. Pat. No. 5,291,743, and discloses certain improvements related thereto.

SUMMARY OF THE INVENTION

The present invention provides refrigerant handling means for drawing refrigerant from a container and removing oil, water and other contaminants from the refrigerant. This invention specifically relates to an improvement which provides a means for automatically purging air and other noncondensable gases from the refrigerant being handled. Certain improvements, including the use of a differential thermostat and an insulated enclosure, are described herein.

DETAILED DESCRIPTION OF THE INVENTION

In the discussion which follows, the basic air purge system of this invention will be discussed with reference to FIGS. 1–3. Then, with reference to FIGS. 4–6, certain additional improvements and characteristics will be discussed.

Figure 1:
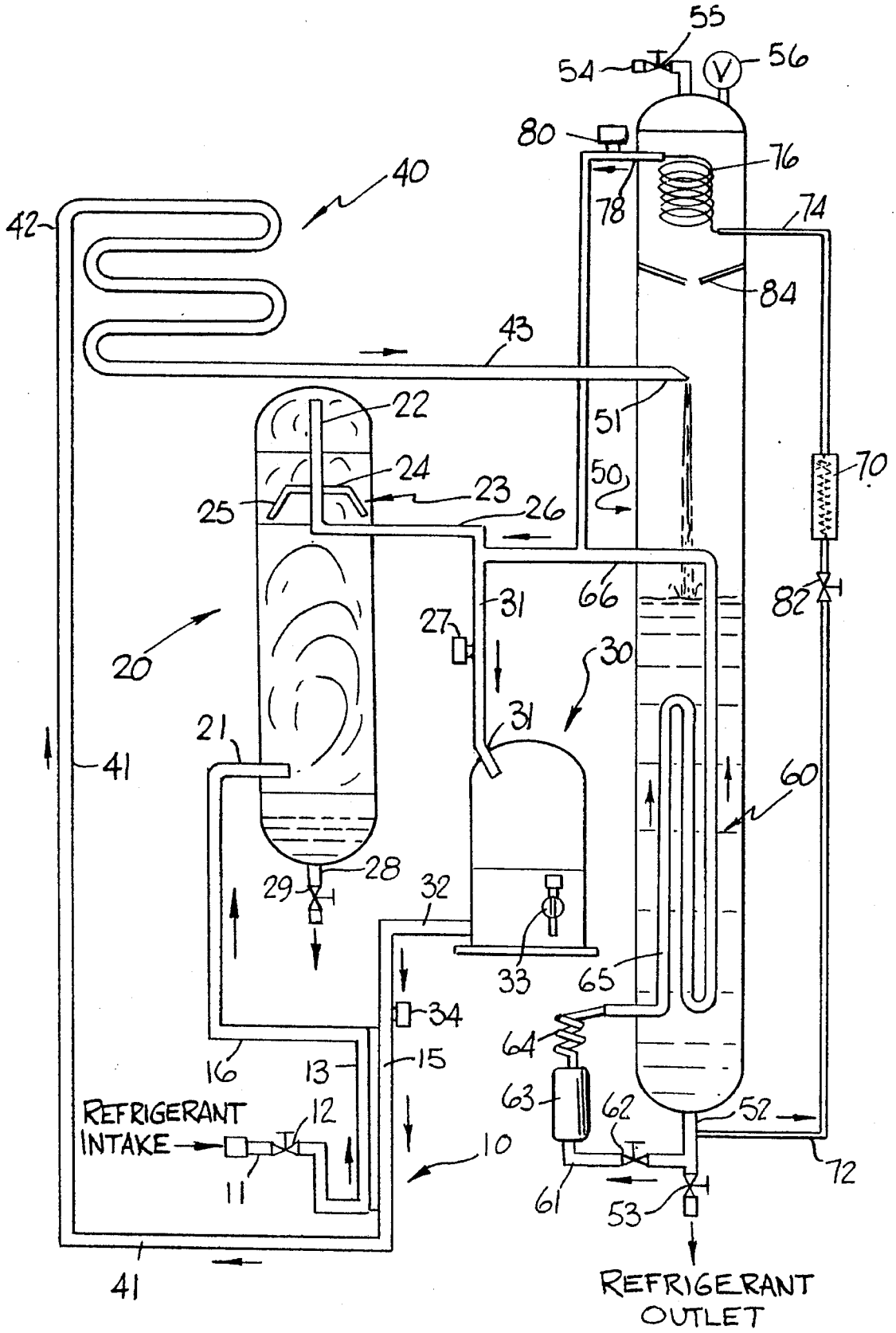
FIG. 1 is a schematic illustration of a refrigerant reclaim system incorporating the automatic air purge system of this invention.

As illustrated in FIG. 1, the reclaim system of this invention includes a heat exchanger 10, one portion of which is in fluid communication with a refrigerant intake conduit 11 controlled by solenoid valve 12. The conduit 11 is in fluid communication with conduit 13 which constitutes the cold side of heat exchanger 10.

Conduit 16 constitutes the outlet from the cold side of heat exchanger 10 and is in fluid communication with oil separator 20 through the conduit 21. The fluid conduit 21 extends through the outer wall of the oil separator tank 20 somewhat above the lower end of the tank and extends inwardly so that its open end is near the axis of the tank. Another fluid conduit 22 has its open end fixed near the inner surface of the rounded top of the tank. The fluid conduit extends downwardly and supports a circular baffle 23 composed of a disc-like portion 24 and a downwardly extending partially cone-shaped skirt 25. Conduit 22 is arranged to extend along the axis of the tank and is connected to fluid conduits 26 and 31. There is an electrical control device 27 on conduit 31 having a pressure gauge indicator associated with it. The control 27 will automatically shut down compressor 30 when the pressure in conduit 31 drops to virtually zero PSIG. Oil from the bottom of oil separator 20 can be discharged through fluid conduit 28 controlled by solenoid valve 29.

Fluid conduit 31 extends through the outer wall of compressor 30 and a short distance into its interior. Compressor 30 is provided with a fluid conduit outlet 32 and an oil sight gauge 33. Outlet conduit 32 has a high pressure activated electrical control device 34 associated with it and is in fluid communication with conduit 15 of heat exchanger 10 and is thus in fluid communication with conduit 41, which in turn is in fluid communication with a condenser 40 through condenser inlet conduit 42. If pressure in conduit 32 is too high, control 34 acts automatically to shut down compressor 30.

Outlet conduit 43 connects condenser 40 in fluid communication with storage tank 50 (also referred to as the chill tank), which as illustrated is an elongated, cylindrical pressure tank arranged with its longitudinal axis extending vertically and having upper and lower ends of partially spherical shape. Outlet end 51 of fluid conduit 43 is located substantially on the axis of chill tank 50. At the bottom of the chill tank 50 there is a fluid conduit 52 controlled by solenoid valve 53 and arranged in fluid communication with the interior of chill tank 50. At the upper end of chill tank 50 there is an air outlet conduit 54 controlled by solenoid valve 55. Also located at the upper end of chill tank 50 is a high pressure activated safety relief valve 56.

Located partially within and partially outside chill tank 50 is a cooling and recycling system 60 composed of a conduit 61 in fluid communication with conduit 52 and controlled by solenoid valve 62. The fluid conduit 61 is in fluid communication with filter-drier 63, which in turn is connected in fluid communication with an expansion device 64. The expansion device illustrated is a capillary tube, but could be an expansion valve or equivalent device. Fluid conduit 61 is also in fluid communication with conduit 65 arranged in the form of a coil within chill tank 50. The cooling coil 65 is in fluid communication with conduit 66, which in turn is in fluid communication with inlet conduit 31 of compressor 30.

Figure 2:
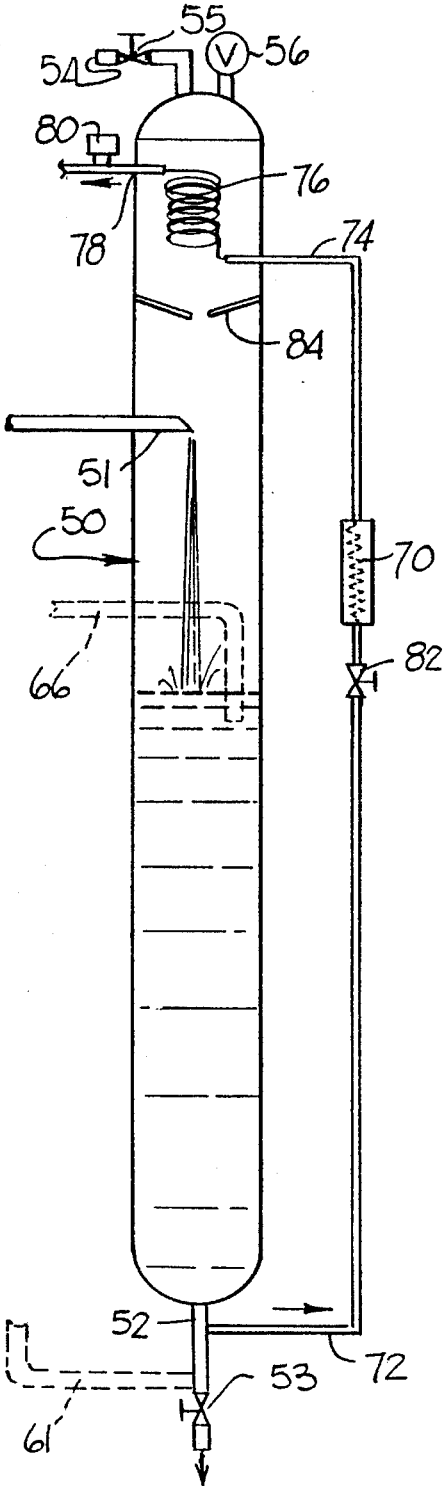
FIG. 2 is a schematic illustration of the automatic air purge system of FIG. 1.

FIG. 2 shows a view of a first embodiment of the automatic air purge system of this invention. In this embodiment, the air purge system is understood to be associated with the chill tank 50 of the reclaim system just discussed. A capillary tube 70 is in fluid communication with fluid conduit 52 at the bottom of the chill tank through inlet conduit 72. Outlet conduit 74 of capillary tube 70 extends through the outer wall of chill tank 50 at the upper end of the chill tank and is in fluid communication with conduit 76 in the form of an evaporator coil within the chill tank. The evaporator coil 76 is in fluid communication with outlet conduit 78. A thermostat 80 is located on conduit 78.

A shut off solenoid valve 82 is in line downstream of conduit 72, and a circular baffle 84 having a hole in the center is fixed in the upper portion of chill chamber 50 beneath evaporator coil 76. Baffle 84 is oriented so that its center hole is aligned with the axis of the chill chamber and is shaped so as to angle down within the chill chamber from the periphery of the baffle to its center, with the center hole being lower than the peripheral edges of the baffle.

At the upper end of chill tank 50 there is an air outlet conduit 54 controlled by solenoid valve 55. Also located at the upper end of chill tank 50 is a high pressure activated safety relief valve 56. As was explained with reference to FIG. 1, outlet 51 extends into chill tank 50 in fluid communication from the condenser (40 in FIG. 1). Solenoid valve 53 controls fluid conduit 52 at the bottom of the chill tank. FIG. 2 does not show the cooling and recycling system (60 in FIG. 1) that is in fluid communication with conduit 52 through conduit 61 and is in fluid communication with the compressor inlet through conduit 66, nor does it show the connection from outlet conduit 78 to compressor 30 through the outlet conduit 66 of the cooling and recycling system 60.

Returning to FIG. 1, it may be seen that evaporator coil 76 is in fluid communication with outlet conduit 78 which in turn is in fluid communication with conduit 66 and with inlet conduit 31 of compressor 30. Likewise, it may be seen that evaporator coil 76 is in fluid communication with capillary tube 70 and, through conduit 72, with the liquid line 52 at the bottom of the chill tank. Accordingly, it may be understood that the automatic air purge system is readily incorporated within the reclaim system previously described.

All of the elements of the reclaim system with automatic air purge can be mounted within a mobile cabinet (not shown) having a control panel in one outer surface and casters underneath it.

The control panel includes a power on-off switch which, depending on the positions of various valves and the pressures at various points in the system, energizes the compressor 30 and the valves 12, 29, 55, 53 and 62. Since controls 27 and 34 shut down or start up compressor 30 automatically when power is on, the control panel need not include switches for manually activating these controls. Hence the control panel need include only, in addition to the power on-off switch, switches for valve 12 (refrigerant in), valve 29 (oil out), valve 53 (refrigerant out), and valve 62 (control for the cooling and recycling system 60).

Additional details about the control panel, cabinet, optional parallel chill tanks, the oil separator, compressor and other components, together with a compilation of items which are standard devices are contained in the disclosure of U.S. Pat. No. 4,967,570 of Van Steenburgh, Jr., which is hereby incorporated by reference herein.

When the reclaim system is utilized in repair of the refrigerating system of an air conditioner, for example, fluid conduit 11 is connected to a refrigerant outlet in the refrigeration system, the power turned on and valve 12 is opened. Control 27 at the inlet to compressor 30 is activated when it senses pressure in fluid conduit 31, and with the power turned on the compressor begins to function. Refrigerant from the refrigeration system is drawn into the reclaim system through conduit 11.

Normally the refrigerant at this point will be a liquid. At some point in fluid conduit 13 of heat exchanger 10 the refrigerant is converted to gaseous form by the heat transferred to it from conduit 15 carrying the output of compressor 30. The refrigerant flows through fluid conduits 16 and 21 into oil separator 20. The refrigerant is at this point relatively hot and is an expanding gas rising within the tank of oil separator 20. The upward flow of gas is abruptly interrupted by the baffle 23 causing oil to be separated and to drop to the bottom of the tank. The gaseous refrigerant passes around the outer (lower) edge of skirt 25 which is spaced from the interior wall of the surrounding tank by an amount which is approximately equal to the open area at the upper end of conduit 22. The gaseous refrigerant passes around skirt 25 into the upper end of fluid conduit 22, then through fluid conduit 26 into fluid conduit 31.

So long as there is sufficient pressure in fluid conduit 31 to indicate that the refrigerant system of the air conditioner has not been completely evacuated, compressor 30 will continue to run. Refrigerant from fluid conduit 31 passes into the compressor, is compressed and discharged through fluid conduit 32 and passes through the heat exchanger in fluid conduit 15 and then through fluid conduit 41 into condenser 40 through condenser inlet 42. The gaseous refrigerant entering the condenser is converted into a liquid at some point in the condenser.

Liquid refrigerant passes out of the condenser 40 into conduit 43 and through that conduit into the upper portion of chill tank 50. At this point valves 53 and 62 are closed and the compressor will continue to withdraw refrigerant from the refrigeration system of the air conditioner, and to cause liquid refrigerant to be discharged into chill tank 50 until the pressure at the inlet to compressor 30 drops to virtually zero PSIG indicating all of the refrigerant has been removed from the refrigeration system of the air conditioner. At this time control 27 will act to shut down compressor 30.

After waiting to see if pressure will again build up in conduit 31 and cause the compressor to start up again, the operator will close valve 12 (refrigerant intake) and open valve 62 causing liquid refrigerant to leave the chill tank 50 through fluid conduit 52 and pass into the filter drier 63 through fluid conduit 61. The liquid refrigerant then passes through expansion device 64 where it is converted into a gas and passes through coil 65 to cool the liquid refrigerant, illustrated in FIG. 1 as filling a portion of the chill tank 50 with the coil 65 submerged in it. When expanding gas from coil 65 reaches the compressor inlet conduit 31 via fluid conduit 66, there will be sufficient pressure to actuate control 27, and the compressor will automatically start running again.

With valve 12 closed, the cold side of heat exchanger 10 and the entirety of oil separator 20 are shut down. With pressure in fluid conduit 31, the compressor continues to operate and the gaseous refrigerant which entered the compressor through conduits 66 and 31 is compressed and discharged from the compressor through fluid conduit 32 and thence through the heat exchanger 10 and condenser 40 back into the chill tank 50 and the cycle just described is repeated again and again until the temperature of the liquid refrigerant in chill tank 50 has been reduced to the desired level, normally about 38 to 45 degrees Fahrenheit.

The repeated passing of liquid refrigerant through filter drier 63 removes substantially all acid and water from the liquid refrigerant. During this recycling, normally a certain amount of air will be separated from the liquid refrigerant and collect in the upper portion of chill tank 50 in an homogeneous mixture with vaporized refrigerant. In a reclaim system without the automatic air purge of this invention, air (together with a certain amount of vaporized refrigerant) would be removed by opening valve 55 so that the air escapes through conduit 54. This would be done when the pressure within chill tank 50 reaches something in excess of 300 PSIG and would be done by activating a switch, preferably a push button, on the control panel. In the event for some reason pressure should reach a level of about 400 PSIG, safety relief valve 56 would be actuated and gases in the system would be vented.

Other steps of the operation of reclaim system, including the measurement and replacement of collected oil, and the utilization of the system to transfer refrigerant from one container to another are described in U.S. Pat. No. 4,967,570 of Van Steenburgh, Jr., previously expressly incorporated herein by reference. Various other improvements and refinements to a reclaim system are described in, for example, U.S. Patent Nos. 4,998,416; 5,050,401; 5,072,593; 5,086,630; and 5,101,641, each of Van Steenburgh, Jr., and the disclosure of each of which is incorporated herein by reference.

Having described a refrigerant handling system such as a refrigerant reclaim system, and having described the way that air would be removed without the automatic air purge of this invention, the automatic air purge will now be discussed.

By way of background, when air or any other noncondensable gas is present in any refrigeration system, it becomes trapped in the high pressure side of the system. In the refrigerant reclaim system just discussed, air will be trapped in the chill tank 50 in the space above the liquid refrigerant. More generally, in any refrigeration system, it will become trapped in the receiver in the space above the liquid refrigerant. Here it becomes an homogeneous mixture with the refrigerant and adds its partial pressure to the refrigerant's saturation pressure. This increased pressure causes the system to function less efficiently because the compressor must pump against this additional high side pressure.

The presence of air or other noncondensable gases can be determined by comparing the actual pressure in the receiver as read on a pressure gauge with the saturation pressure of the refrigerant being used at the temperature maintained in the receiver. If the actual pressure, as measured at the gauge, is higher than the predicted saturation pressure, the difference may be attributed to noncondensable gases, and the system needs to be purged.

For example, in an R-12 refrigeration system, if the difference between the measured gauge pressure and the predicted saturation pressure at 100 degrees Fahrenheit is 20 psi, this 20 psi difference is caused by approximately 3% by weight of noncondensable gas in the vaporized refrigerant-and-noncondensable gas mixture. In order to purge all of the noncondensable gas from the system (without having the automatic air purge of this invention) it would be necessary simply to vent the entire homogeneous mixture of refrigerant-and-noncondensable gas present in the receiver. If there were 1 cubic foot of space above the liquid refrigerant in the receiver, then, in the example given, there would be about 3.35 pounds of homogeneous vapor in the system, comprising about 3.25 pounds of R-12 vapor and 0.10 pounds of noncondensable gas. To eliminate the tenth of a pound of air by simple venting would lose about thirty-three times as much refrigerant into the atmosphere. This is not only wasteful of refrigerant, but may also be prohibited by environmental regulations.

The presence of noncondensables poses a problem in refrigeration systems, and it also poses a problem in refrigeration handling systems, including systems like the reclaim system previously discussed. When refrigerants are removed from any type of refrigeration system by a refrigerant recovery, recycling or reclaim machine, any air or other noncondensable gases that were in the refrigeration system will be drawn into the recovery, recycling or reclaim apparatus (referred to hereafter, for convenience, as "the reclaim system"). The noncondensables must then be removed from the reclaim system. Without the automatic air purge system of this invention, removal of noncondensables has often been accomplished by a simple purge of the entire refrigerant vapor-noncondensable gas mixture to the atmosphere with the wasteful discharge of considerable refrigerant accompanying the elimination of the noncondensables.

The automatic air purge system of this invention is designed to concentrate the noncondensable gases in an area isolated from the main volume of the refrigerant vapor in the receiver (that is, as illustrated with the reclaim system described herein, in the chill tank 50). Thus, when the purging takes place from this isolated area, a lesser amount of refrigerant vapor will be lost. This isolation is accomplished by using the evaporator coil 76 in combination with the baffle 84 in the upper portion of chill tank 50.

The evaporator coil 76 can be a number of turns of copper tube or any appropriate heat exchanger, with the precise configuration being relative to the size of the system into which it is being installed, and as is well known to those skilled in the art. Liquid refrigerant is drawn off from chill tank 50 by conduit 72 which is in fluid communication with liquid outlet line 52 carrying liquid refrigerant out of the chill tank. Conduit 72 feeds the liquid refrigerant through valve 82, capillary tube 70, and conduit 74 into the evaporator coil 76. After passing through the evaporator, the refrigerant is vaporized, and the vaporized refrigerant is discharged through conduit 78 into the suction line 31 of the compressor 30 via conduit 66.

As the mixed vaporized refrigerant-and-noncondensable gas circulates above the liquid refrigerant in chill tank 50, the evaporator 76 will cool and condense the refrigerant. The condensed refrigerant will collect on the surface of the evaporator coil, and will drain back to the liquid refrigerant in the lower portion of the chill tank 50. The noncondensable gases will be left in the gas phase in the isolated area above the baffle 84. As more of the mixed vaporized refrigerant-and-noncondensable gas enters the isolated area above the baffle 84 to take the place of the condensed refrigerant, the condensing process continues until there is no more noncondensable gas to concentrate, or the isolated volume becomes bound with noncondensable gas and no more condensation can take place at the existing evaporator coil temperature.

The necessity of purging can be determined by monitoring the temperature at outlet conduit 78 from the evaporator coil 76. As long as there is refrigerant condensing on the surface of the evaporator coil, there will be a substantial load on the evaporator. The capillary tube 70 or other metering (expansion) device is sized so that the evaporator 76 will never flood with refrigerant as long as condensation is taking place. However, if enough noncondensable gases are concentrated in the isolated area above the baffle 84 so that no more condensation can take place, the evaporator will flood, lowering the temperature of outlet conduit 78 to saturation suction temperature, thus indicating that purging should take place.

The air purge is accomplished automatically by placing a thermostat 80 at outlet conduit 78, for opening the purge valve 55 at a predetermined temperature. An alternate means for automatic purging could be by way of a mechanical float of the type described in U.S. Pat. No. 4,953,357 of Van Steenburgh, Jr., previously incorporated herein by reference. Finally, a non-automatic method of purging could use a temperature indicating device on the control panel to tell the operator that the system should be manually purged.

Assuming that evaporator coil 76 is operating at 0 degrees Fahrenheit, the concentration of noncondensable gas is many times greater than what it was at the 100 degree example given previously. This also means that only a fraction of the amount of refrigerant could be lost in a simple purge operation (without the noncondensable gas concentration device of the automatic air purge of this invention) compared to the previous example. When the 0 degree F. operating temperature is combined with the automatic air purge of this invention, the amount of lost refrigerant is substantially less than before.

The air purge apparatus need not be an integral part of the receiver (or, as illustrated here, the chill chamber 50) as shown in FIGS. 1 and 2. Instead, and as shown in FIG. 3, the air purge apparatus could be in a separate concentration chamber 90 in fluid communication with the receiver. As illustrated in FIG. 3, a capillary tube 70 is in fluid communication with fluid conduit 52 at the bottom of the chill tank through inlet conduit 72, and solenoid valve 82. Outlet conduit 74 of capillary tube 70 extends through the outer wall of concentration chamber 90 at the lower end of the chamber and is in fluid communication with conduit 76 in the form of an evaporator coil within the concentration chamber. The evaporator coil 76 is in fluid communication with outlet conduit 78. A thermostat 80 (not shown in FIG. 3) is located on conduit 78.

At the upper end of concentration chamber 90 there is an air outlet conduit 54 controlled by solenoid valve 55. Located at the upper end of chill tank 50 is a high pressure activated safety relief valve 56. As was explained with reference to FIG. 1, outlet 51 extends into chill tank 50 in fluid communication from the condenser (40 in FIG. 1). Solenoid valve 53 controls fluid conduit 52 at the bottom of the chill tank. FIG. 3 does not show the cooling and recycling system (60 in FIG. 1) that is in fluid communication with conduit 52 through conduit 61 and is in fluid communication with the compressor inlet through conduit 66, nor does it show the connection from outlet conduit 78 to compressor 30 through the outlet conduit 66 of the cooling and recycling system 60.

Figure 3:
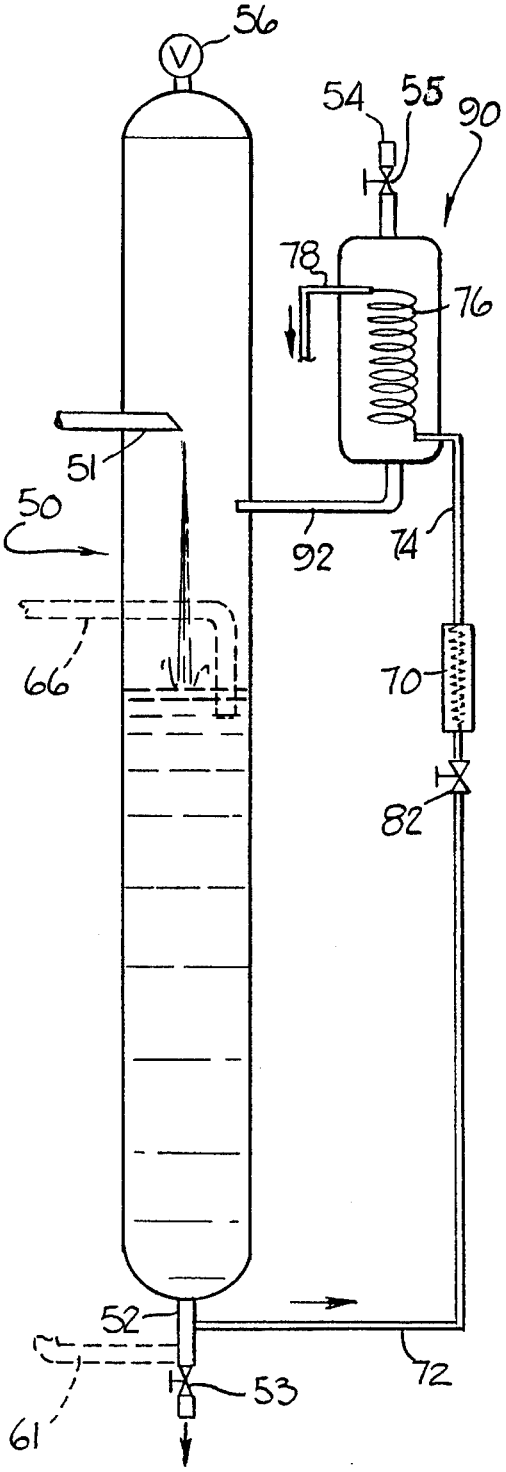
FIG. 3 is a schematic illustration of a second embodiment of the automatic air purge system of this invention.

The concentration chamber 90 shown in FIG. 3 draws in a vaporized mixture of gaseous refrigerant and air (or other noncondensable gas) from chill tank 50 via inlet tube 92. As the mixed vaporized refrigerant-and-noncondensable gas circulates in concentration chamber 90, the evaporator 76 will cool and condense the refrigerant. The condensed refrigerant will collect on the surface of the evaporator coil, and will drain back, through conduit 92, to the liquid refrigerant in the lower portion of the chill tank 50. The noncondensable gases will be left in the gas phase and isolated in the concentration chamber 90. As more of the mixed vaporized refrigerant-and-noncondensable gas enters the isolated area within the concentration chamber to take the place of the condensed refrigerant, the condensing process continues until there is no more noncondensable gas to concentrate, or the isolated volume becomes bound with noncondensable gas and no more condensation can take place at the existing evaporator coil temperature.

The necessity of purging can be determined by monitoring the temperature at outlet conduit 78 from the evaporator coil 76. As long as there is refrigerant condensing on the surface of the evaporator coil, there will be a substantial load on the evaporator. The capillary tube 70 or other metering (expansion) device is sized so that the evaporator 76 will never flood with refrigerant as long as condensation is taking place. However, if enough noncondensable gases are concentrated in the concentration chamber 90 so that no more condensation can take place, the evaporator will flood, lowering the temperature of outlet conduit 78 to saturation suction temperature, thus indicating that purging should take place.

Thus, it can be seen that, in this second embodiment, the concentration chamber 90 shown in FIG. 3 serves to concentrate noncondensable gases in an isolated area with a reduced admixture of vaporized refrigerant, and accomplishes the same function as the first embodiment, previously discussed with reference to FIGS. 1 and 2. The embodiment of FIG. 3 otherwise operates as does the first embodiment.

In either embodiment, solenoid valve 82 can be used to control the flow of refrigerant to the capillary tube 70 and the evaporator coil 76. The solenoid 82 could be set to open whenever the compressor is running. Multiple evaporator coils 76 could be installed on refrigeration handling systems having multiple receivers. Alternatively, multiple receivers could be interconnected in parallel so that a single evaporator coil could be sufficient.

Improvements and Other Characteristics

The automatic purge device of this invention will automatically detect when noncondensables are present and can be set either to notify an operator that purging is required (for manual purge) or to automatically open and close the purge valve (completely automatic purge). The device also concentrates the noncondensable gasses so that only a small amount of refrigerant gas is mixed with the noncondensables and the device therefore limits the loss of refrigerant gas.

This device is intended to be installed in the upper portion of a chill chamber 50 (with reference to FIGS. 1–3) on a refrigerant reclaim machine of the type shown in U.S. Pat. No. 5,195,333 of Van Steenburgh, Jr. It can however, be readily produced as a separate component and located external to any refrigerant-containing tank or cylinder as shown in connection with FIG. 3.

Figure 4:
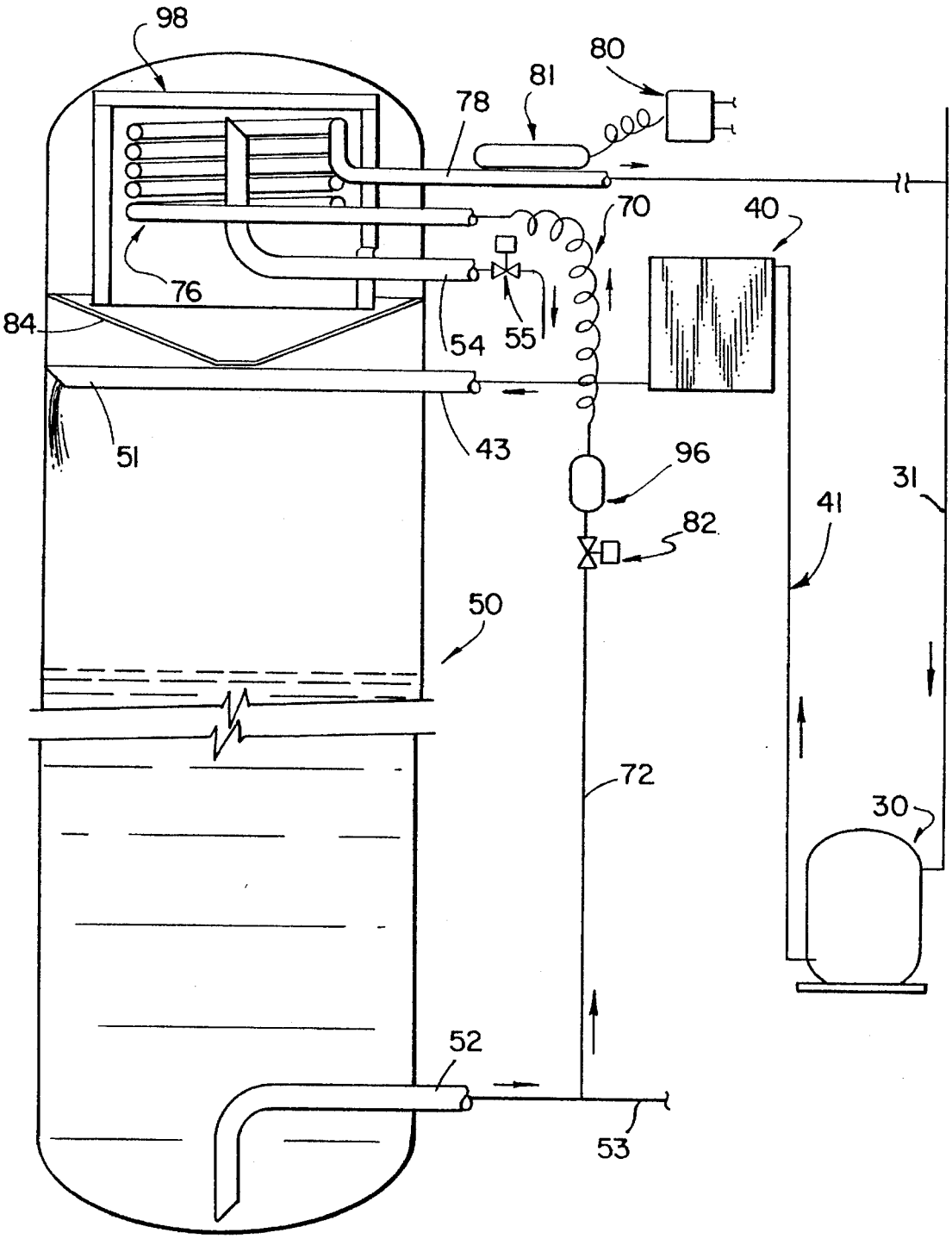
FIG. 4 is a schematic illustration of an alternate embodiment of the automatic air purge system of FIG. 2, including an insulating enclosure.

With reference to FIG. 4, it may be understood that, in the purge mode, the air purge device of this invention completes a refrigeration cycle using the compressor 30, condenser 40, and chill chamber 50 of the reclaim system in series with the capillary tube 70 and evaporator 76 of the purge device. It may be seen that FIG. 4 shows certain other elements of the air purge device in slightly different orientation from the views previously discussed with reference to FIGS. 1–3. It may be seen that the air outlet conduit 54 of FIG. 4 is oriented towards the side of chamber 50 rather than towards the top. In addition, a filter/strainer 96 is shown downstream of shut off solenoid valve 82 in conduit 72, and the evaporator is contained within an enclosure 98 and above circular baffle 84.

The purge evaporator 76 operates at a low temperature in the upper portion of the chill chamber 50 where high pressure refrigerant gas is present. The evaporator 76 acts as a condenser and condenses refrigerant on the outside of the evaporator tube. The capillary tube 70 is sized so that while the purge evaporator 76 is under the load of condensing refrigerant, there is substantial superheat leaving the evaporator. However, if noncondensables are present, they are concentrated in the evaporator enclosure 98 as the refrigerant gas condenses and leaves behind the noncondensables. These noncondensables tend to insulate the evaporator 76 from its condensing load. Without a load on the evaporator, refrigerant floods through the evaporator causing the temperature at the evaporator outlet 78 to drop drastically. The thermostat bulb 81 located at the evaporator outlet 78 senses this drop in temperature and closes its contacts to indicate that purging should take place.

Figure 5:
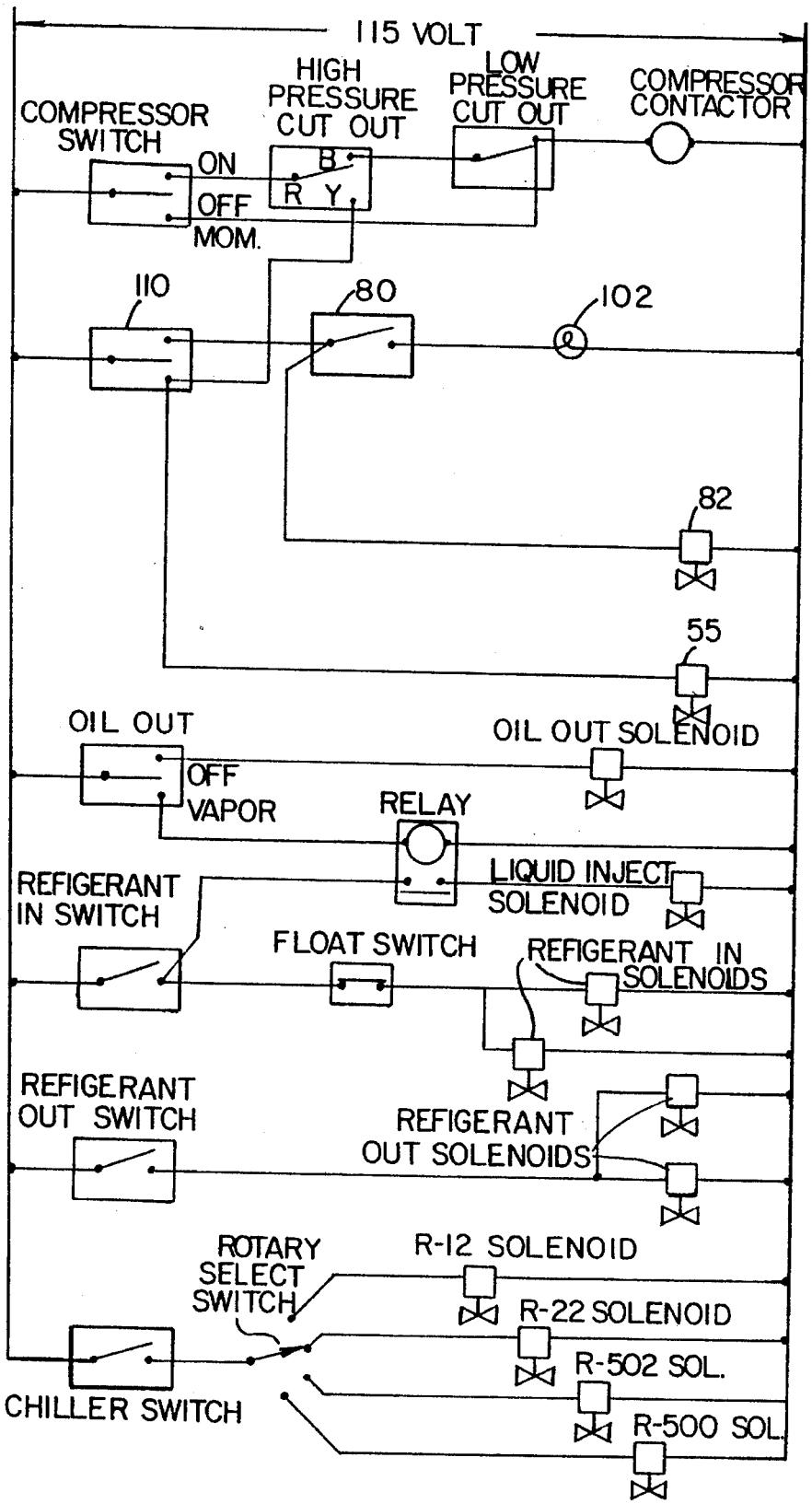
FIG. 5 is a wiring diagram for the embodiment of FIG. 4, showing the use of the purge device as an indicator for the option of a manually initiated purge.

Control options available permit the reaction of the thermostat bulb 81 to be used by the purge device of this invention in two ways:

The temperature drop/closed contact can be used as an indicator by turning ON an indicator light 102 with reference to FIG. 5 that will indicate to an operator purging is necessary (manual purge); or The temperature drop/closed contact can be used to initiate an automatic purge by opening the purge solenoid valve 55 (fully automatic purge).

Figure 5A:
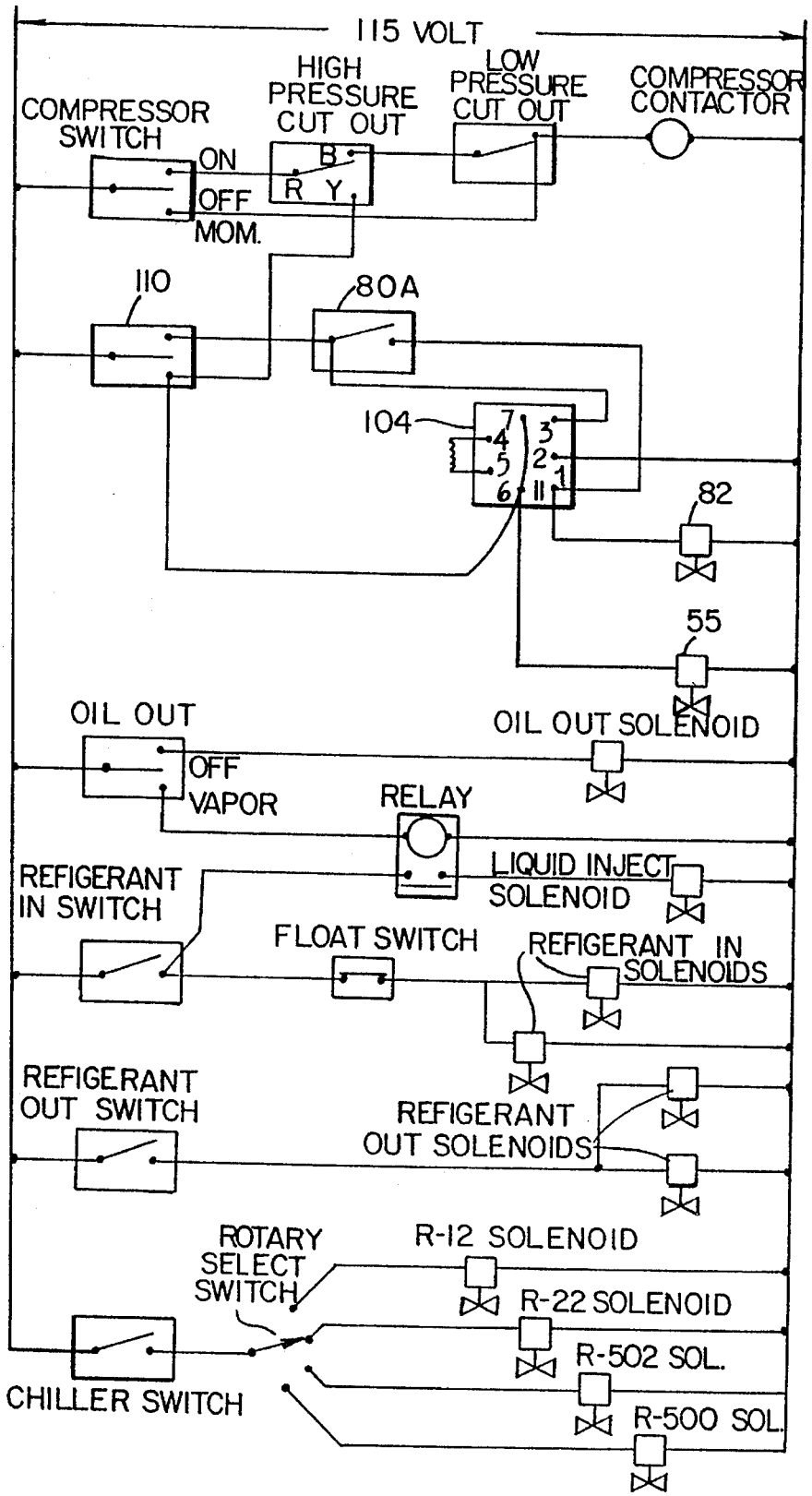
FIGS. 5A, 5B and 5C are wiring diagrams and schematics for the embodiment of FIG. 4, showing the use of the purge device to initiate an automatic purge using a thermostat and "one shot timer" (FIG. 5A); using a differential thermostat (FIG. 5B); and showing the schmatic diagram for a differential thermostat (FIG. 5C).
Figure 5B:
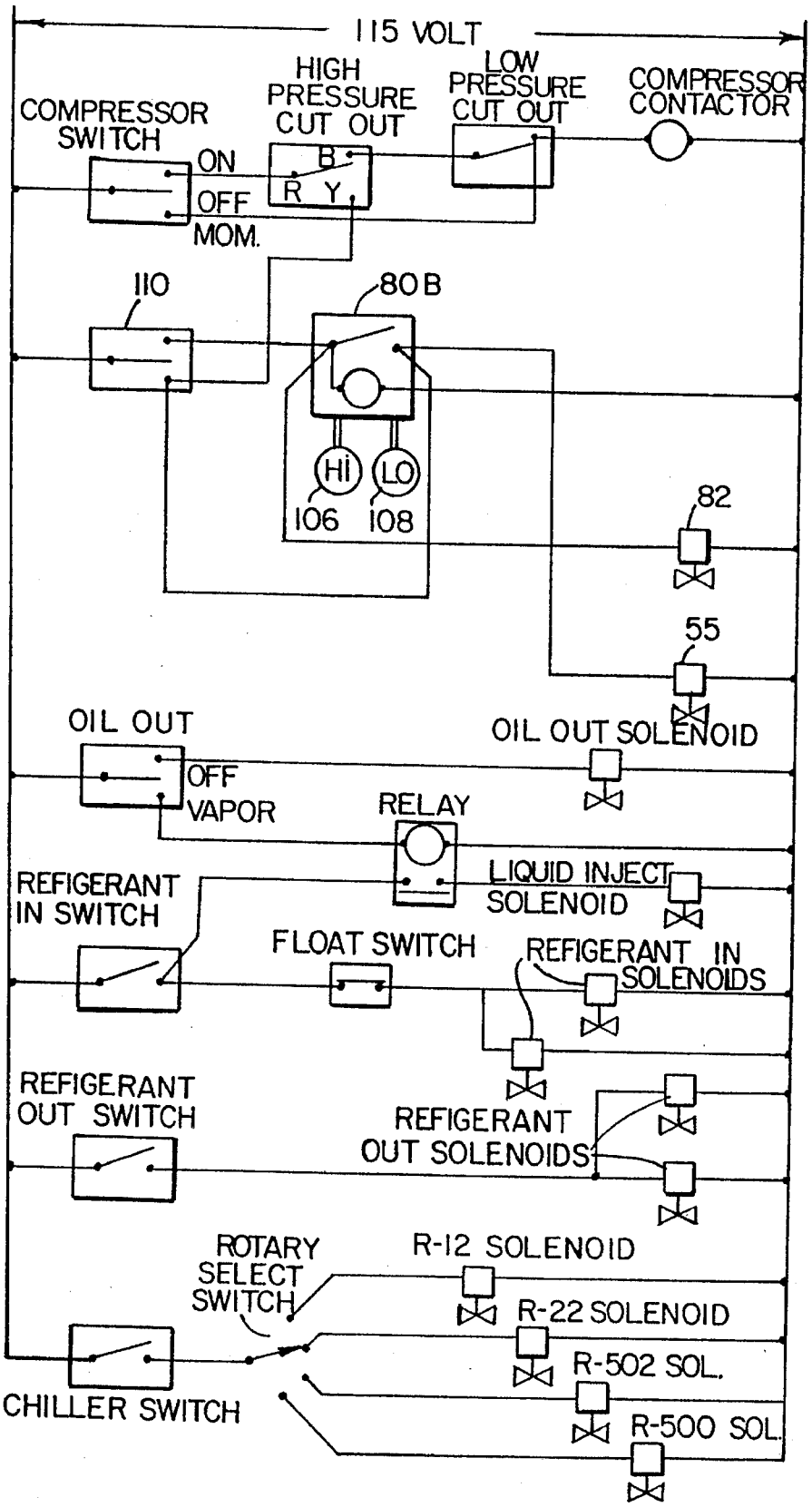

A set of controls for the fully automatic purge mode can be readily understood with reference to FIGS. 5A and 5B. FIG. 5A shows a close-on-temperature-drop thermostat 80A which may be understood to be located at the outlet 78 of the evaporator 76. When thermostat 80A closes it initiates a "single shot" timer 104 which opens the purge solenoid valve 55 for a predetermined time. The "single shot" timer 104 is used to attempt a more consistent purge time and to more nearly eliminate the possibility of the thermostat 80A closing and remaining closed at low ambient temperatures for a long period of time thus allowing excess refrigerant to escape through the purge outlet 54 in case the purge switch/solenoid valve 55 is left on.

It has been noticed that a disadvantage of using thermostat 80A to initiate the purge is that the following condition might arise: if there are excessive noncondensables in the chill chamber 50, the temperature at evaporator outlet 78 may not rise enough after an initial purge to reset the thermostat 80A to the open position. In this case the "single shot" timer 104 will not reset to allow another purge to take place until a defrost toggle switch (not shown) is turned off and on again—this might require a manual intervention.

FIG. 5B shows the improvement of a temperature differential thermostat 80B having a high temperature probe 106 understood to be located on the side of the chill chamber 50, and having a low temperature probe 108 understood to be located at the outlet 78 of the evaporator 76. It was noticed during testing programs that when noncondensables were not present the temperature at the evaporator outlet 78 approached the temperature of the chill chamber 50. As noncondensables increased, the temperature differential between the side of the chill chamber 50 and the evaporator outlet 78 gradually increased. This took place regardless of the ambient temperature. Accordingly, the use of a temperature differential rather than an absolute temperature to initiate the defrost can dramatically improve the operation of the purge device. The differential thermostat 80B can react so rapidly to noncondensables being purged that the "single shot" timer (104 with reference to FIG. 5A) is not necessary.

Figure 5C:
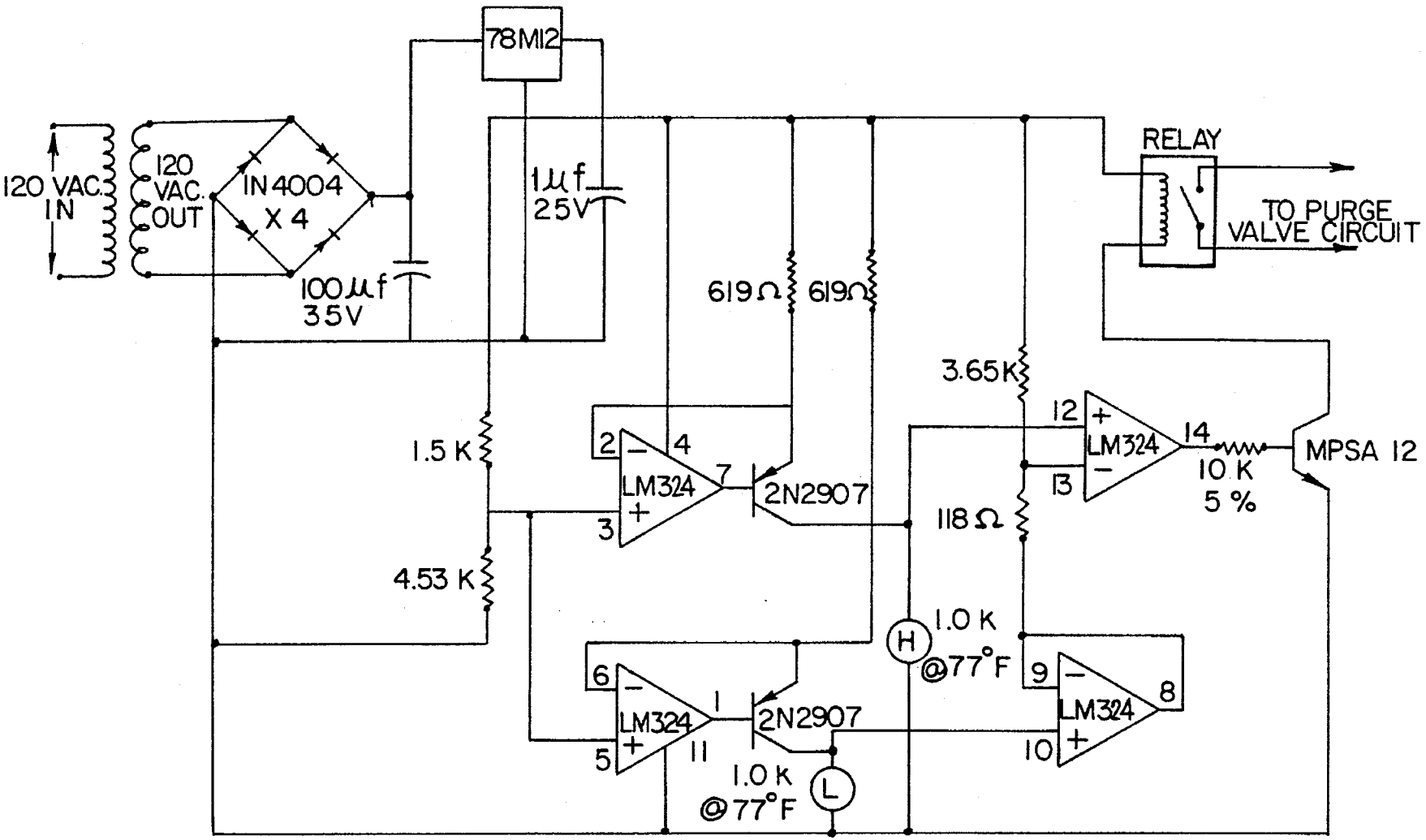

The inventors have had success using a differential temperature thermostat 80B produced according to the schematic diagram of FIG. 5C.

Tests were run at various ambient temperatures with chill chambers 50 set half full of refrigerant. A known amount of dry nitrogen was introduced into the reclaim machine through the refrigerant inlet port (11 with reference to FIG. 1). The amount of dry nitrogen introduced was an amount sufficient to raise the head pressure 10-psig. The reclaim machine was then run in the "Vapor" mode to keep the compressor 30 running at low suction temperature and the refrigerant valve 82 to the purge evaporator 76 was opened. The ambient temperature, chill chamber temperature, and refrigerant temperature entering and leaving the evaporator 76 were recorded on a strip chart. When the temperature leaving the evaporator 76 dropped to the thermostat set point, a purge was automatically initiated. The time required after the nitrogen was introduced into the system until a purge took place varied between 2 and 10 minutes depending on the ambient temperature. The lower the ambient temperature, the less time it took to purge.

Reclaim units, refrigerants and ambient conditions tested, are summarized in the chart below.

| | CV-15 | | | LV-30 | | | JV-90 | | |
|---|---|---|---|---|---|---|---|---|---|
| | 50° | 70° | 105° | 50° | 70° | 105° | 50° | 70° | 105° |
| R-12 | | X | X | | | | X | X | X |
| R-22 | | X | X | | X | | X | X | X |
| R-502 | | X | | | | | | | |

Figure 6:
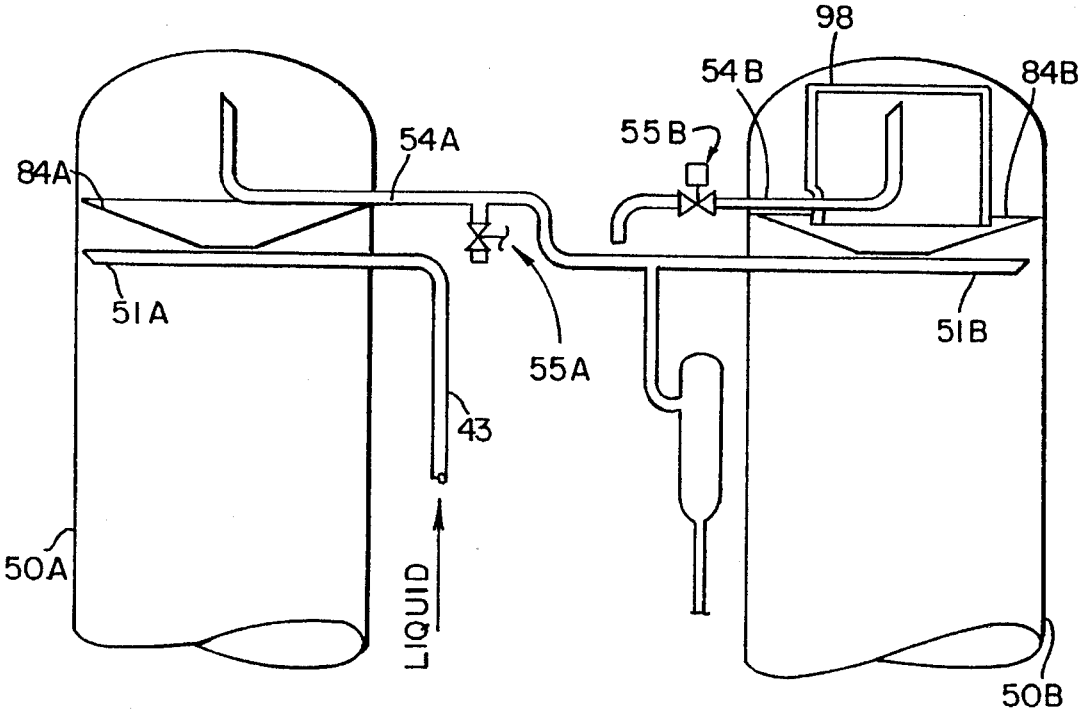
FIG. 6 is a schematic illustration of the embodiment of FIG. 4, showing the interconnection of multiple chambers.

In the application of the air purge device of this invention to various Van Steenburgh-manufactured reclaim units of the type shown in U.S. Pat. No. 5,195,333, the same purge device can be used on all of the units mentioned in the chart above. On units such as that referenced as the "JV-90" which uses two chill chambers 50A and 50B, one air purge device (understood to be contained within enclosure 98) can be used at the top of the right hand chill chamber 50B with the chill chambers 50A and 50B interconnected as shown in FIG. 6.

In all cases, in order to keep the compressor 30 cool and running during the purge cycle, the unit must be run with the "Vapor" switch in the ON position.

Following is a set of the instructions that should be followed if the automatic purge device is used:

"To purge MANUALLY, hold purge switch in the MANUAL position for approximately 15 seconds.

To purge AUTOMATICALLY, VAPOR switch must be in the ON position and the purge switch in the AUTOMATIC position. Allow unit to run in the AUTOMATIC purge mode for 10 minutes. If noncondensables are present, purging will automatically take place. If no purge takes place, noncondensables are not present."

With reference to FIG. 4, it will be recalled that the basic components of the air purge device are an evaporator 76 consisting of several turns of ¼" OD copper tube; a capillary tube 70 used as a metering device; a refrigerant filter/drier (strainer) 96; a solenoid valve 82 to control the liquid refrigerant entering the capillary tube and evaporator; an evaporator enclosure 98 consisting of a material that has some insulating qualities and which isolates the evaporator 76 on the top and sides; a purge outlet tube 54 leading from the top of the evaporator enclosure 98 to the purge valve 55; and a purge valve that controls the flow of purge gas to the atmosphere.

It was determined during testing and development that in order for the air purge device to work better at high ambient temperature conditions, it was necessary to provide some insulation around the evaporator 76. This appears to prevent the sensible heat load at high ambient from offsetting the lack of latent load when noncondensables were present (which would allow the refrigerant to flood through and drop the temperature at the evaporator outlet 78). This insulation was provided by using a plastic evaporator enclosure 98 rather than one made of metal.

Other control components are a single pole double throw main control switch 110 to activate either automatic or manual purging; the combination of a remote bulb thermostat 80A and an interval timer 104 or a temperature differential thermostat 80B with two remote sensors 106 and 108 (as illustrated in FIGS. 5A and 5B).

The following materials may be used as the components for an air purge device constructed according to this invention:

Refrigerant Solenoid Valve 82: ¼" Sporlan;

Filter/drier 96: Sporlan C-032, ¼";

Capillary Tube 70: 0.093" OD×0.042" ID×72" long;

Evaporator 76: ¼" OD×0.030" wall×66";

Evaporator Enclosure 98: plastic, 4" ID×4½" OD×3¾" high with top end closed;

Suction Line from evaporator 76 to compressor suction line 31: ⅜" OD×0.032" Wall×approx. 24";

Toggle Switch 110: Cutler-Hammer, SPDT, On-Off-Momentary-On;

Thermostat 80A: Johnson Controls, Model XA19AGF-4001, Engineering Sample No. 593021, Range 20° to 80° F., 1.5° to 2° F. differential, screw driver slot range adjustment;

Single Shot Timer 104: Artisan Controls, Model 4210A-8-B-2;

Resistor: ¼ watt, 470K ohms used on timer 104;

Differential Thermostat 80B (to be used in place of thermostat 80A, single shot timer 104, and resistor): close on increase temperature differential of about 25 degrees. Manufactured according to FIG. 5C.

As previously indicated, the air purge device of this invention is not confined to use with a refrigerant reclaim, but may be used in any refrigerant handling system or refrigeration system from which air is to be purged. The foregoing discussion in connection with a refrigerant reclaim is illustrative only and is not intended as a limitation upon the practice of this invention.

What is claimed is:

1. In a refrigeration system having a vaporized refrigerant and a noncondensable gas in a gaseous mixture above a liquid refrigerant within a storage tank, an air purge system, comprising:

(a) means, including expansion means, for feeding liquid refrigerant from said refrigeration system into an evaporator, and an outlet conduit in fluid communication with said evaporator for returning refrigerant to the refrigeration system, (b) means for bringing said gaseous mixture into contact with the evaporator, thereby condensing at least a portion of said vaporized refrigerant out of the gaseous mixture and increasing the concentration of said noncondensable gas within the gaseous mixture, (c) an air outlet in fluid communication with said evaporator for releasing the gaseous mixture out of the refrigeration system, (d) an insulated enclosure, at least a substantial portion of the top and sides of said evaporator being enclosed therein, and (e) isolation means for at least partially isolating the evaporator from the storage tank, wherein the evaporator is held within the storage tank above the liquid refrigerant, and said isolation means includes a baffle disposed within the storage tank between the evaporator and the liquid refrigerant, said baffle having an opening for admitting the gaseous mixture.

2. The air purge system of claim 1, wherein the baffle is circular in shape and includes a disc-like portion having a partially cone-shaped skirt extending downwardly therefrom, said opening being a circular hole located near the center of the disc-like portion thereof.

3. The air purge system of claim 1, further comprising means for opening said air outlet when the temperature in said outlet conduit varies from a predetermined temperature.

4. The air purge system of claim 3, wherein said means for opening said air outlet is automatically controlled.

5. The air purge system of claim 3, wherein said means for opening said air outlet is manually controlled.

6. The air purge system of claim 1, further comprising means for opening said air outlet when the temperature in said outlet conduit varies from a predetermined temperature, wherein said means for opening said air outlet includes a thermostat having a first sensor and a second sensor, the first sensor being disposed to sense a first temperature at an outlet of said evaporator, the second sensor being disposed to sense a second temperature at said storage tank.

* * * * *